US007059451B2

(12) United States Patent
Richey et al.

(10) Patent No.: US 7,059,451 B2
(45) Date of Patent: Jun. 13, 2006

(54) LOAD LOWERING SYSTEM

(76) Inventors: William H. Richey, 7501 26th Ave. NW., Seattle, WA (US) 98117; John Bolding, 10549 Evanston Ave. N., Seattle, WA (US) 98133

( * ) Notice: Subject to any disclaimer, the term of this patent is extended or adjusted under 35 U.S.C. 154(b) by 193 days.

(21) Appl. No.: 10/816,243

(22) Filed: Apr. 1, 2004

(65) Prior Publication Data

US 2004/0195045 A1 Oct. 7, 2004

Related U.S. Application Data

(63) Continuation-in-part of application No. 10/672,214, filed on Sep. 25, 2003, now abandoned.

(60) Provisional application No. 60/413,968, filed on Sep. 26, 2002.

(51) Int. Cl.
*B66B 9/00* (2006.01)
*B66B 9/16* (2006.01)

(52) U.S. Cl. ..... 187/239; 187/242; 187/351; 182/84

(58) Field of Classification Search ..... 187/351, 187/242, 267, 268, 239; 182/84; 254/13, 254/98, 99, 342
See application file for complete search history.

(56) References Cited

U.S. PATENT DOCUMENTS

| | | | | |
|---|---|---|---|---|
| 240,193 | A | 4/1881 | Shaw | |
| 267,204 | A | 11/1882 | Hinkle | |
| 278,847 | A | 6/1883 | Baker | |
| 378,882 | A | 3/1888 | Glasscock | |
| 392,753 | A | 11/1888 | Read et al. | |
| 401,106 | A | 4/1889 | Backman | |
| 463,670 | A | 11/1891 | Shannon | |
| 509,106 | A | 11/1893 | Shannon | |
| 737,547 | A | 8/1903 | Young | |
| 780,249 | A | 1/1905 | Withey | |
| 832,113 | A | 10/1906 | Worthington | |
| 885,560 | A | 4/1908 | Worthington | |
| 1,110,499 | A | 9/1914 | Laborda | |
| 1,110,566 | A | 9/1914 | Laborda | |
| 2,529,112 | A | 11/1950 | Steele | 228/44 |
| 3,477,543 | A | 11/1969 | Vigluicci | 182/76 |
| 3,692,145 | A | 9/1972 | Banner | 182/70 |
| 3,715,011 | A | 2/1973 | Prather | 182/100 |
| 3,946,833 | A | 3/1976 | Riehlmann | 182/20 |
| 4,341,286 | A | 7/1982 | Gregory | 182/10 |
| 4,425,982 | A | 1/1984 | Kibbie | 182/36 |

(Continued)

*Primary Examiner*—Kathy Matecki
*Assistant Examiner*—Terrell Matthews
(74) *Attorney, Agent, or Firm*—Dean A. Craine

(57) ABSTRACT

A system for mechanically lowering a load from an elevated position to a lower position in a relatively slow and controlled manner using only gravity and frictional forces. The system includes a vertically aligned glide rod, a glide collar that moves longitudinally over the glide rod, two vertically mounted friction rods mounted on opposite sides of the glide rod, a friction collar that moves longitudinally along each friction rod, and a support platform coupled to each friction collar and to the glide collar. The glide rod includes spiral vane along its entire length upon which the glide collar rides when a load is placed on the support platform, allowing the support platform to descend at a safe speed via gravity. The friction rod and collars are used to move the support platform from a stored position located above the elevated loading position to a lower position so that a load may be placed onto the support platform and to stabilize the support platform as it descends from the loading position to the ground.

20 Claims, 14 Drawing Sheets

U.S. PATENT DOCUMENTS

| | | | | |
|---|---|---|---|---|
| 4,434,871 | A | 3/1984 | Niedworok | 182/198 |
| 4,488,621 | A | 12/1984 | Schiewe | 187/70 |
| 4,515,241 | A | 5/1985 | Gebelius | 182/96 |
| 4,548,298 | A | 10/1985 | Born | 187/25 |
| 4,703,832 | A | 11/1987 | Fontenot | 182/100 |
| 4,815,561 | A | 3/1989 | Ostrander | 182/21 |
| 5,277,254 | A * | 1/1994 | Rullman et al. | 166/241.4 |
| 5,377,778 | A | 1/1995 | Lan | 182/48 |
| D370,736 | S | 6/1996 | Douglas et al. | D25/64 |
| 6,328,129 | B1 | 12/2001 | Ferguson | 182/70 |
| 6,676,233 | B1 * | 1/2004 | Evans et al. | 312/247 |
| 2004/0262086 | A1 * | 12/2004 | Korchagin et al. | 187/239 |

* cited by examiner

LOAD LOWERING SYSTEM

This is a continuation-in-part patent application based on the provisional patent application (Application No. 60/413,968) filed on Sep. 26, 2002 and the utility patent application (application Ser. No. 10/672,214) filed on Sep. 25, 2003 and now abandoned.

BACKGROUND OF THE INVENTION

1. Field of the Invention

This invention relates to systems used to lower a load from an elevated location to a lower location, and more particularly, for such systems that include a platform that moves in a slow, controlled manner.

2. Description of the Related Art

Exterior mounted fire escape systems that allow residents in the building to escape during a fire or emergency situation in the building are well known. One type of system includes a motor-driven carriage that moves over a rail vertically mounted on the outside of the building. One drawback with such systems is that the movement of the carriage is dependent upon a constant supply of electricity to operate the motor. Another drawback with such systems is that they are relatively complex and use an electric motor and switches that require connection to the building electrical circuits.

SUMMARY OF THE INVENTION

It is an object of the present invention to provide a load lowering system that can be installed on the side of a building and used as a fire or emergency escape system for residents in the building.

It is another object of the present invention to provide such a system that is mechanically operated and does not require the use of electricity.

These and other objects of the present invention are met by a system for mechanically lowering a fragile load from an elevated position to a lower position in a relatively slow and controlled manner. The system is specifically described as a fire escape system mounted on the exterior wall of a building. It should be understood, however, that the system may be used in other applications where it is desirable to move a load in a relatively slow controlled manner.

The system includes a vertically aligned glide rod, a glide collar that moves longitudinally over the glide rod, at least one vertically mounted glide means mounted on the exterior wall and adjacent to the glide rod for controlling the movement of the glide collar over the glide rod, and a support platform coupled to the glide collar. In the preferred embodiment, the system also includes two vertically aligned friction rods located on opposite sides of the glide rod and mounted to the exterior wall of the building, and a friction collar that moves longitudinally over each friction rod.

The glide rod includes a continuous spiral groove located between a laterally extending spiral vane. The glide collar includes a non-rotating upper bearing plate securely attached to the bottom surface of a support platform and a lower bearing plate member that rotates around the glide rod. Roller or ball bearings are disposed between the upper bearing plate and the lower bearing plate so that the weight of a load placed on the support platform is transferred to the lower bearing plate. Attached to the lower bearing plate are two pivoting vane engaging glide points that extend inward and slide over the top surface of the vane as the lower bearing plate descends over the glide rod. As the lower bearing plate descends on the glide rod, it rotates while the upper bearing plate remains stationary so that user situated on the support platform does not rotate. The diameter of the glide rod, the pitch of the spiral groove and the angle of the spiral vane are set at a desired amount so that the support platform descends at a desired rate on the glide rod when transporting a load to the ground.

During assembly, the two friction rods and the glide rod are vertically aligned and mounted on the sides of a building. The two friction rods vary in diameter at different locations along their lengths which increases and decreases the forces applied by the friction collars as they descend on the friction rods. Each friction collar includes means for adjusting the amount of friction exerted on the friction rod so that the rate of descent of the friction collar on the friction rod may be controlled for a specific amount of load weight. The two friction collars are attached to an upper frame assembly located above the support platform upon which the load to be lowered is placed. During use, the diameters of the friction rods gradually increase or decrease so that the friction collars are used to control the descent of the upper frame assembly from a stored position located above the escape opening to the ground. The friction rods are also used secondarily to stabilize the support platform as it descends from the escape opening to the ground.

An optional storage mechanism is provided for storing the upper frame assembly and the support platform in a collapsed, stored position above the escape opening. An optional re-lift cable and pulleys are provided for raising the carriage from the ground to the escape opening or to the stored position.

DESCRIPTION OF THE PREFERRED EMBODIMENT(S)

Figure 1B:
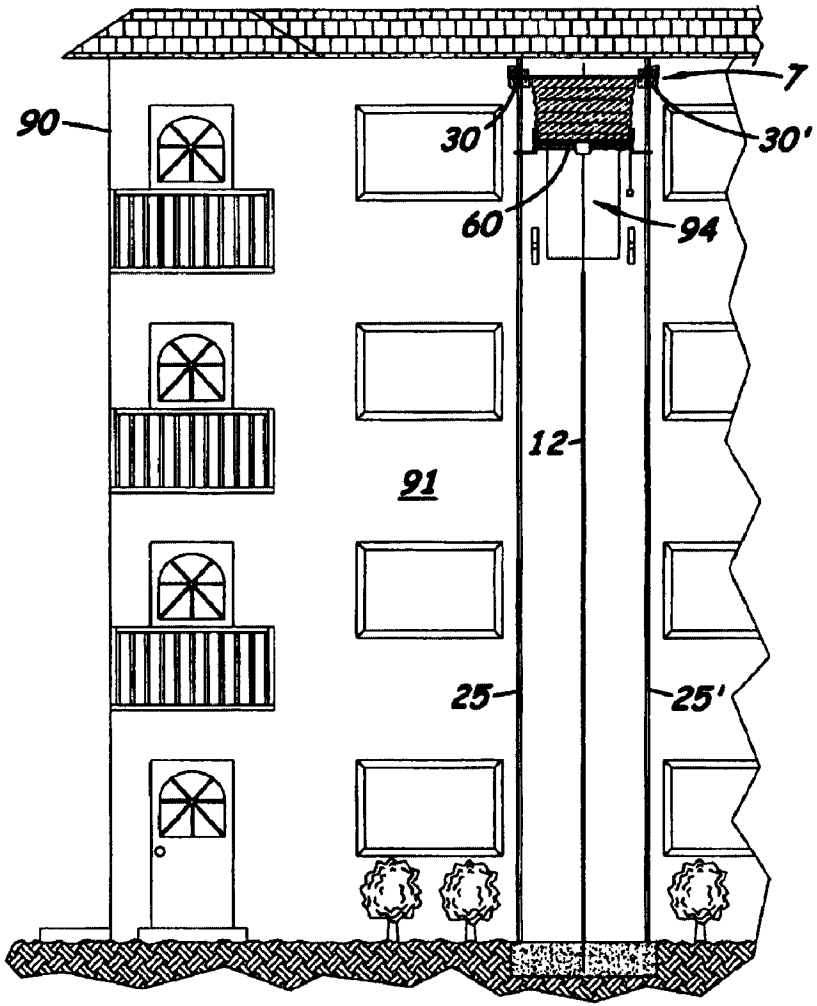
FIGS. 1A–J are side elevational views of a building showing the sequential movement of the load lowering system installed on the sides of a building and being used by users to escape from an elevated opening.
Figure 1A:
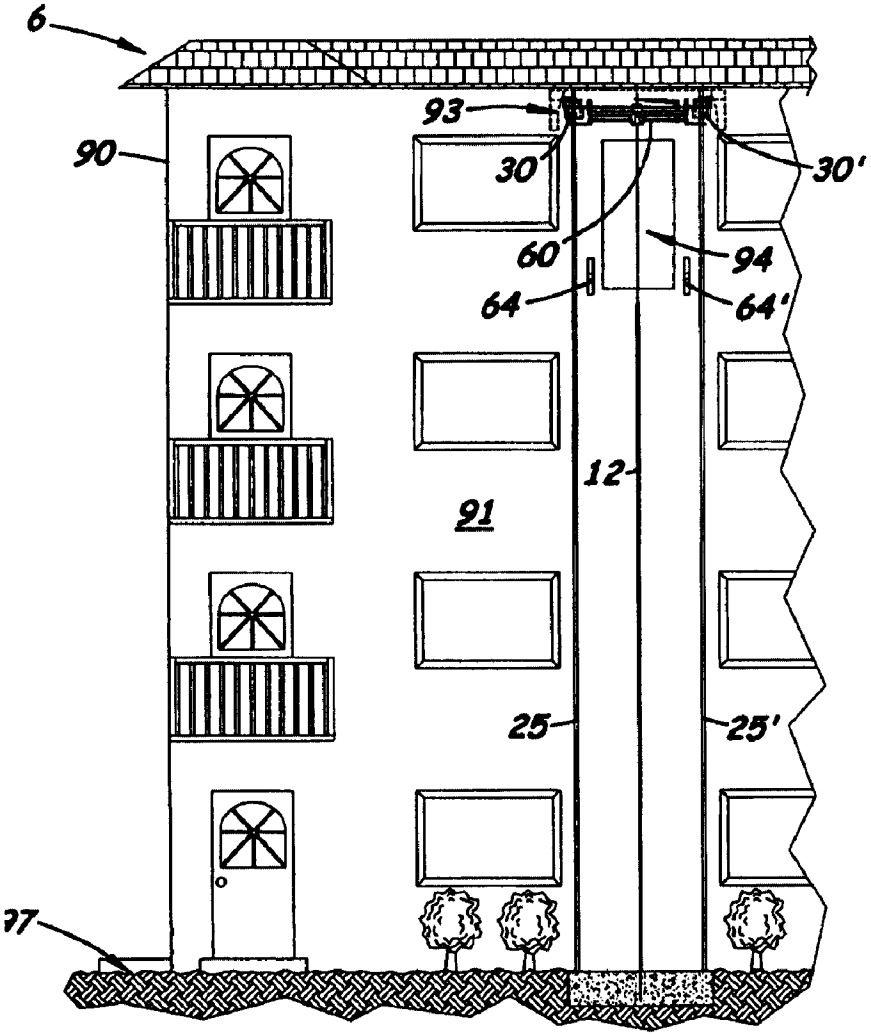
Figure 1D:
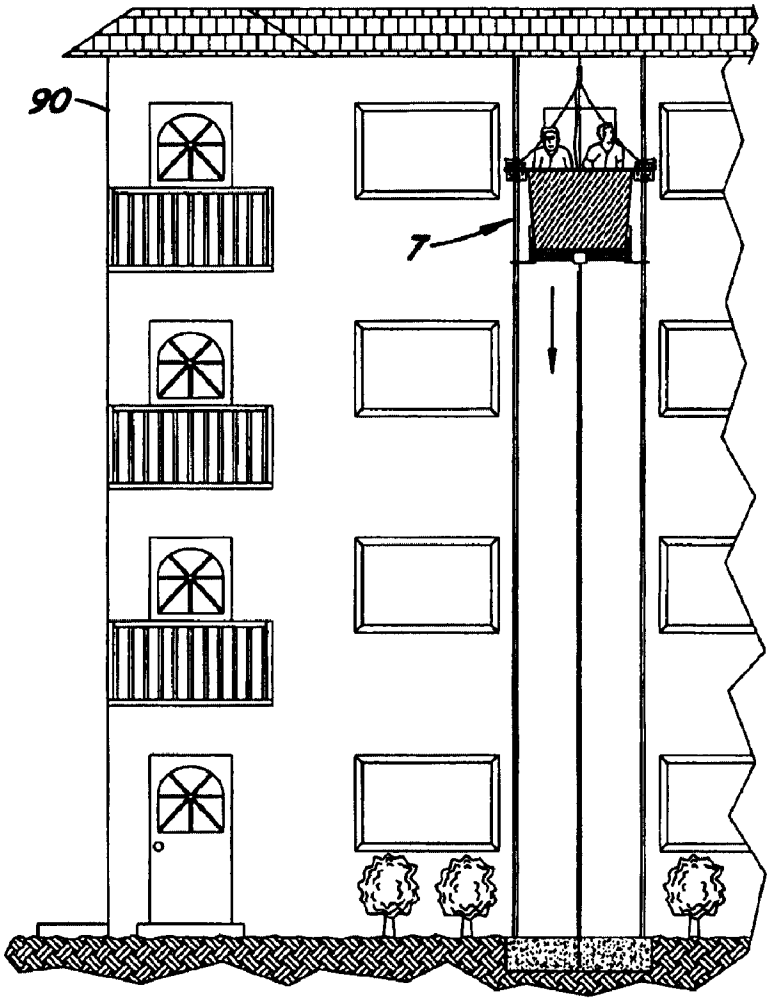
Figure 1C:
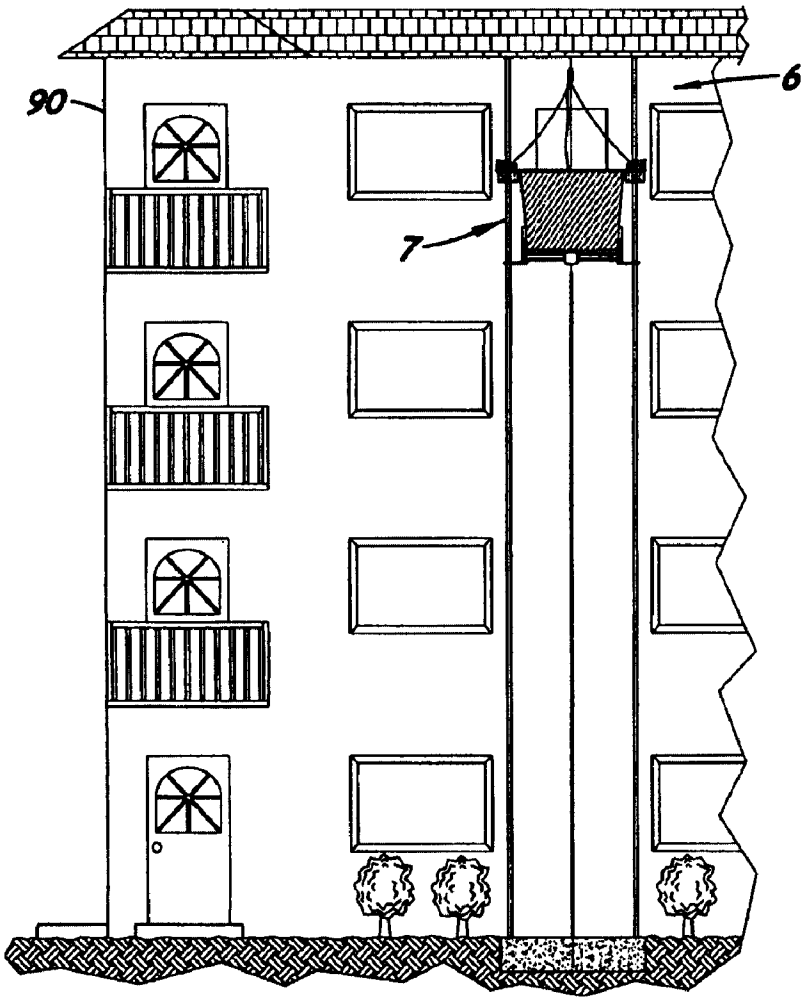
Figure 1F:
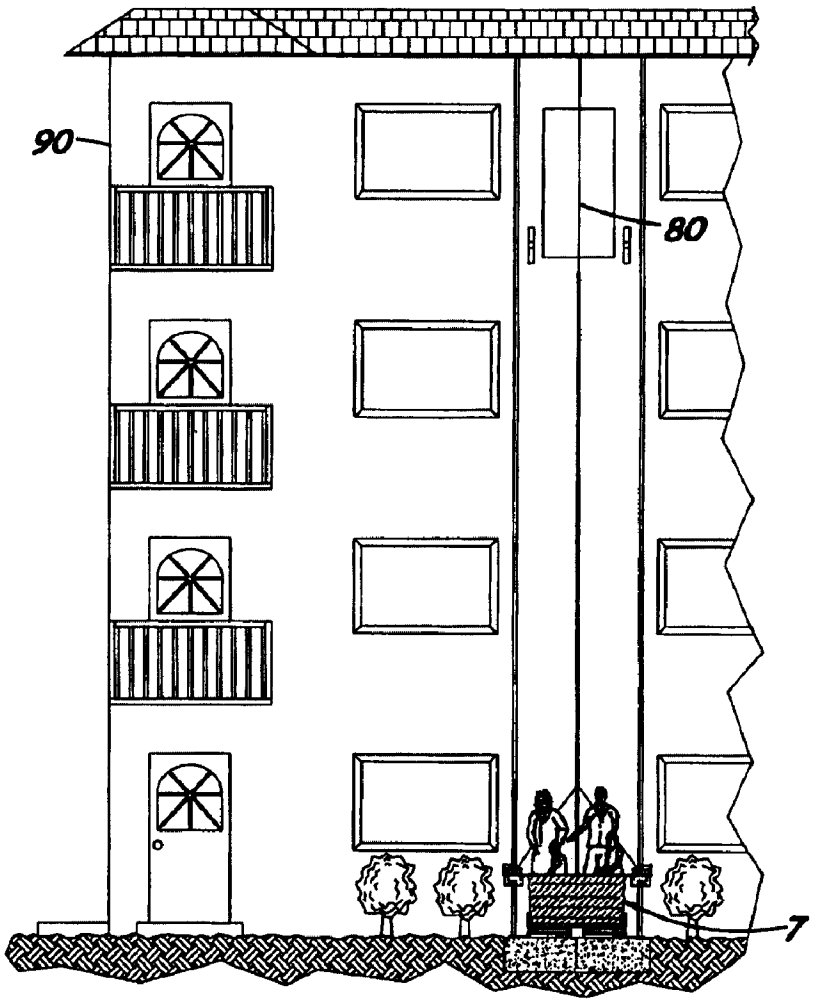
Figure 1E:
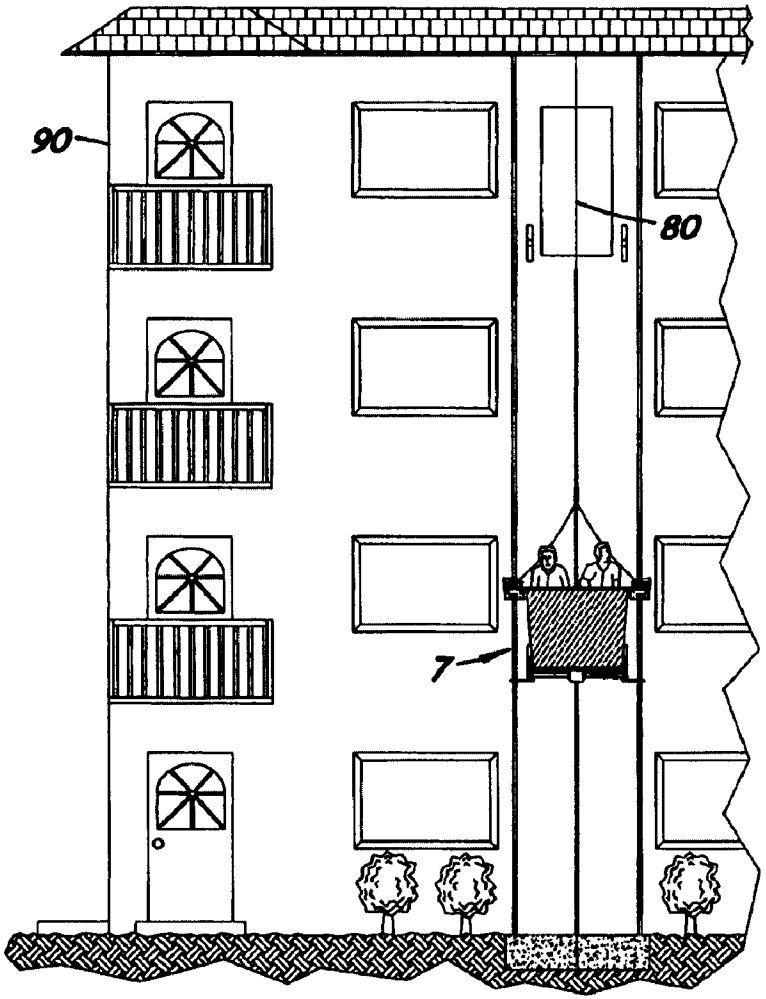
Figure 1H:
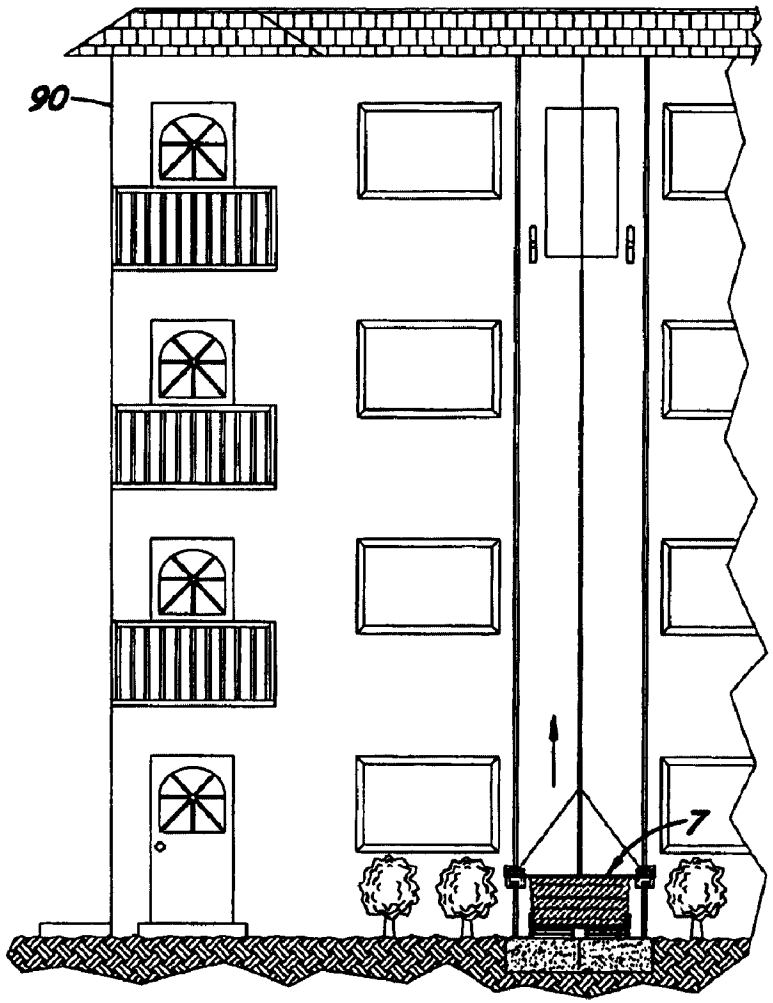
Figure 1G:
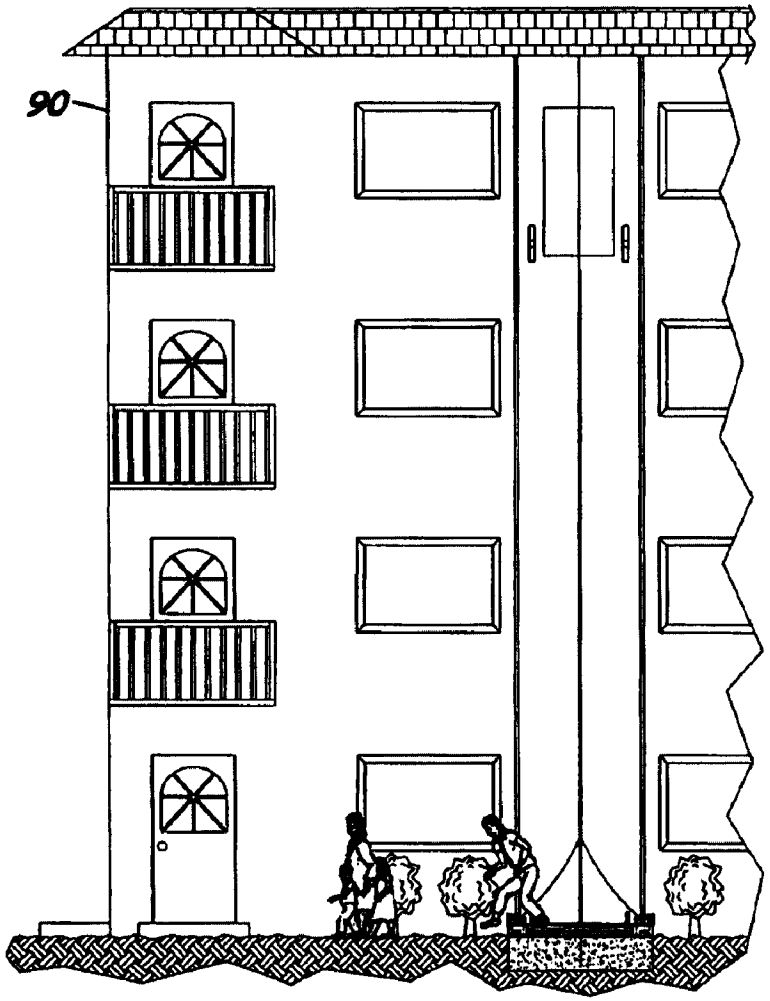
Figure 1J:
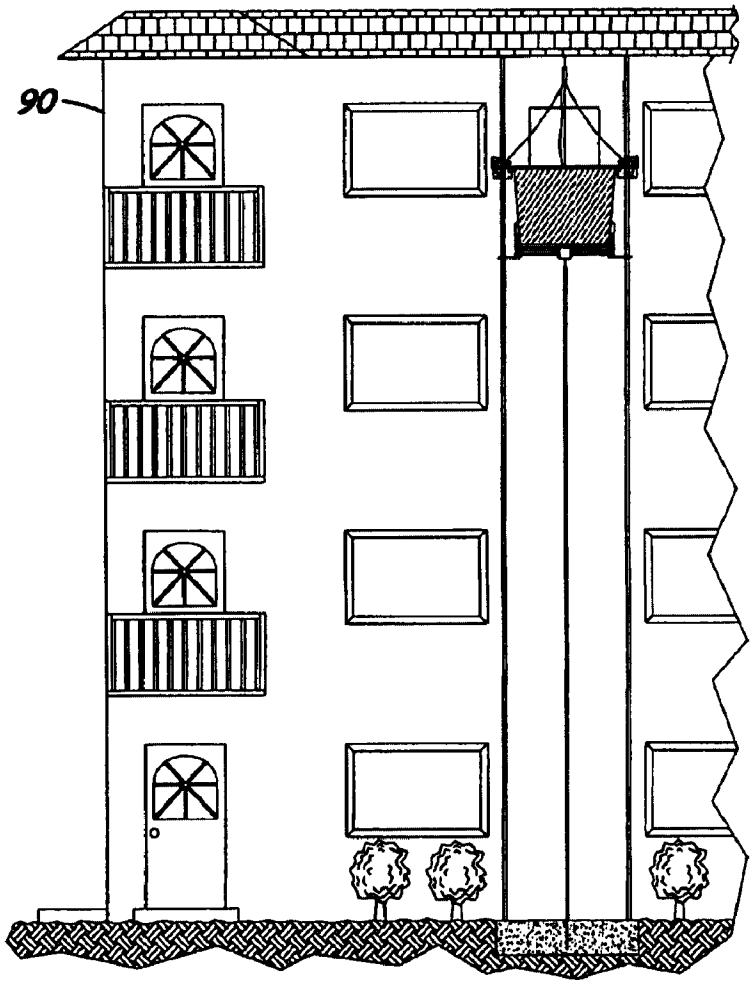
Figure 1I:
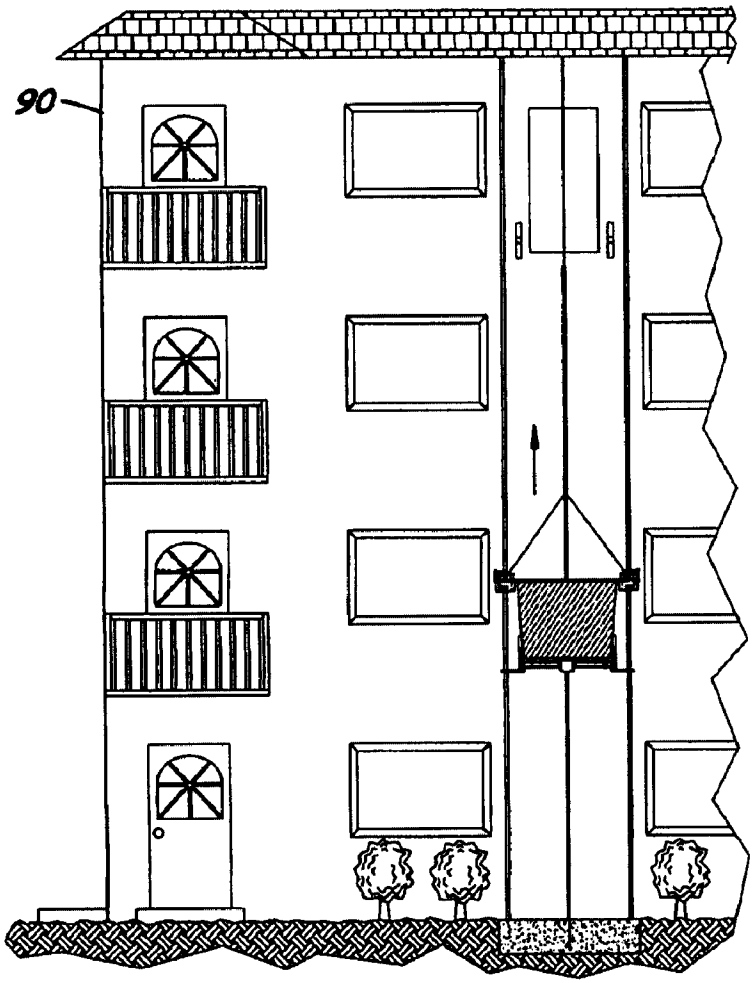

Shown in the 1A–1J is a system 6 for mechanically lowering a load from an elevated position, to a lower position in a relatively slow and controlled manner. The system 6, which is specifically designed not to require electricity, includes a load carrying carriage 7 that is initially stored in an elevated stored position 93 located above an escape opening 94 formed on the wall 91 of a building 90. When an emergency exists that requires a user located in the upper floor of a building 90 to quickly leave the building 90, an escape mechanism is activated which causes the carriage 7 to automatically descend from an elevated position 93 located on the wall 91 to the escape opening 94. The user then exits the building through the escape opening 94 and enters the carriage 7. The carriage 7 is then released from the escape opening 94, and slowly descends to the ground 97 where the user departs. The carriage 7 may then be returned to the escape opening 94 to pick up additional users or returned to the stored position 93. Two key features of the system 6 are that it is mechanical and does not require electricity and the carriage 7 always lowers the user at a safe, controlled rate regardless of the weight of the user' weight.

Figure 2:
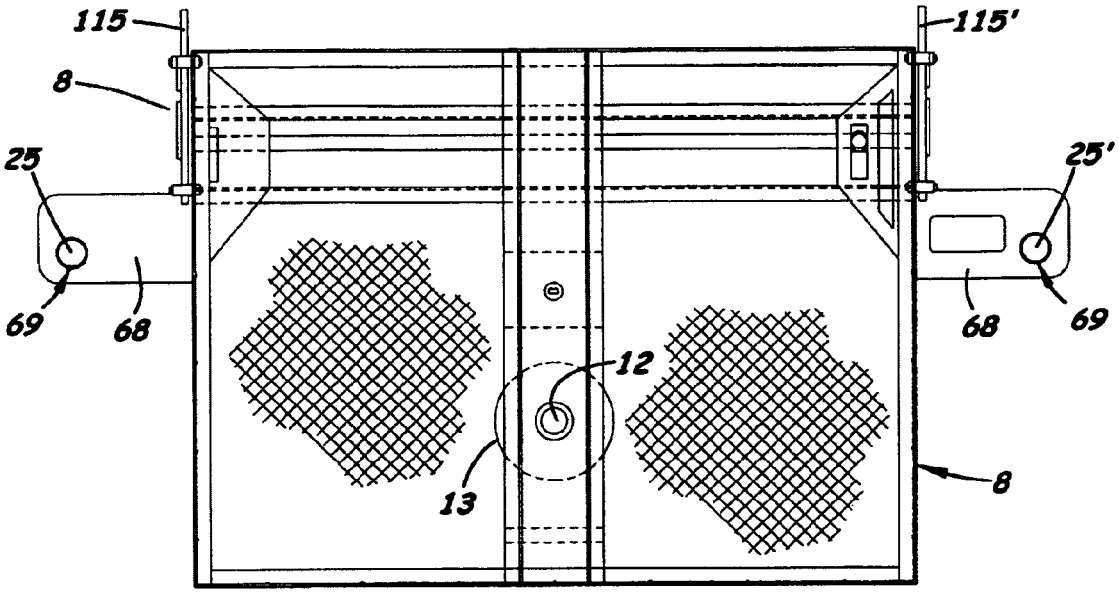
FIG. 2 is a top plan view of the lower frame assembly.
Figure 3:
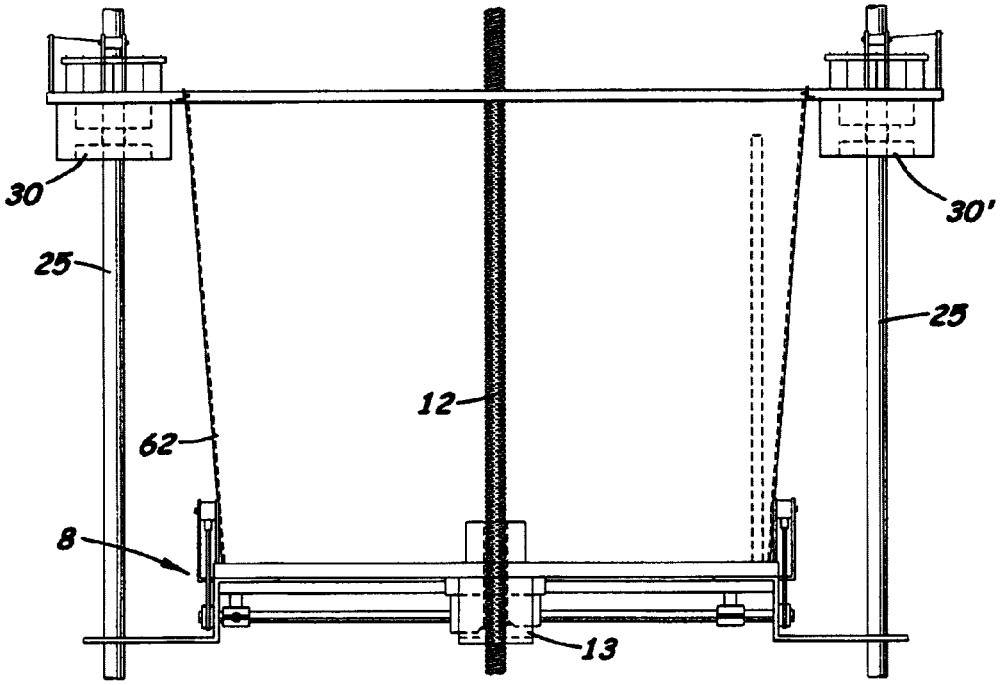
FIG. 3 is a front elevational view of the expanded carriage.

The carriage 7, which is shown more clearly in FIGS. 2 and 3, includes a lower frame assembly 8, an upper frame assembly 10 and a three-sided, flexible canopy 62. The lower frame assembly 8 includes a glide collar 13 that rides on a vertical aligned glide rod 12 mounted on the exterior wall 91 of a building 90. Assembled on opposite sides of the glide rod 12 are two vertically aligned friction rods 25, 25' that are engaged by two friction collars 30, 30', respectfully, attached to the upper frame assembly 10.

Figure 4:
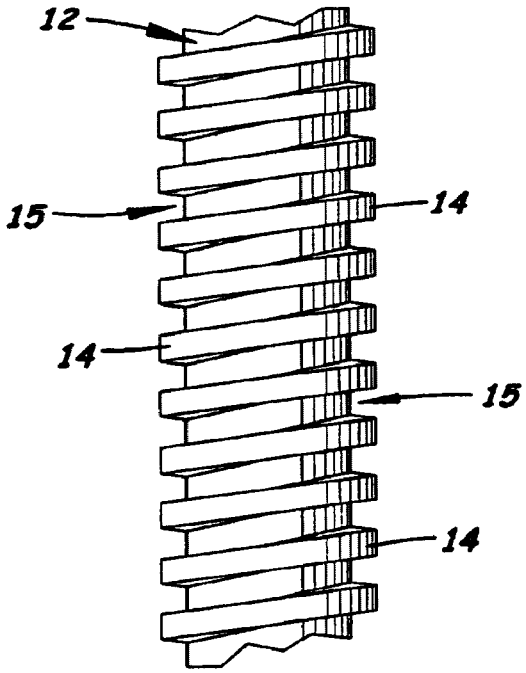
FIG. 4 is a front elevational view of a section of the glide rod.

As shown in FIG. 4, the glide rod 12 includes a spiral groove 15 separated by a laterally extending spiral vane 14 formed over the section of the glide rod 12 that extends from the ground to the escape opening 94. During operation, a glide collar 13 attached to the lower frame assembly 8 rides over the vane 14 when a load is placed on the loading surface on the lower frame assembly 8, herein after called a support platform 60. As shown more clearly in FIGS. 5 and 6, the glide collar 13 includes an upper bearing plate 16 securely attached to the bottom surface of the support platform 60. The upper bearing plate 16 is a flat circular structure with a circular bearing raceway 44 formed on its lower surface. Formed centrally on the upper bearing plate 16 is a circular opening 19 through which the glide rod 12 extends. Securely attached to the perimeter of the upper bearing plate 16 is a downward extending retaining ring 17 designed to hold a rotating lower bearing plate 20 under the fixed upper bearing plate 16.

Figure 5:
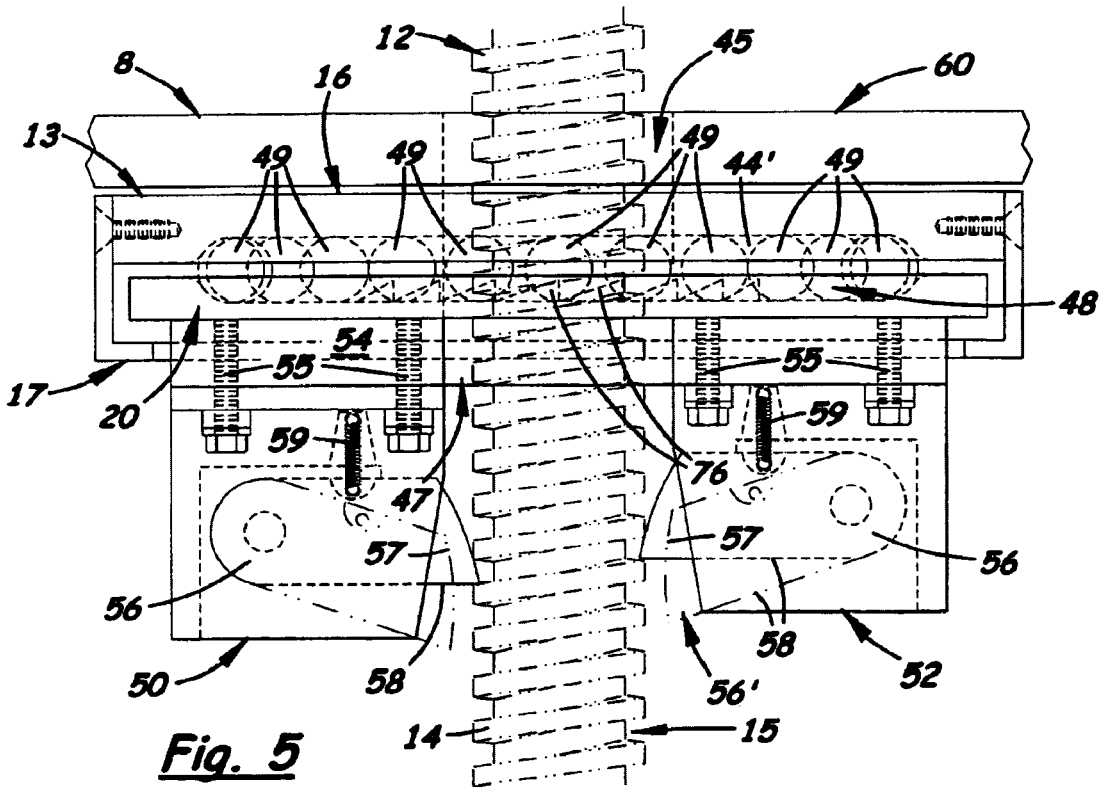
FIG. 5 is a front elevational view of the lower frame showing the support plate, the upper bearing plate, and lower bearing plate of the glide collar mounted on the glide rod.
Figure 7:
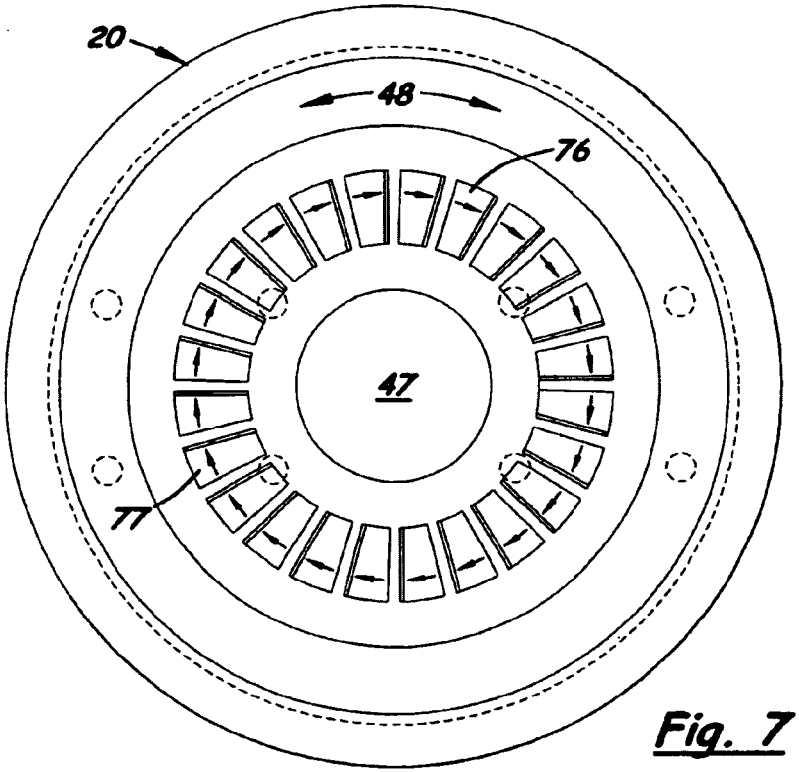
FIG. 7 is a top plan view of the glide collar's lower bearing plate.
Figure 8:
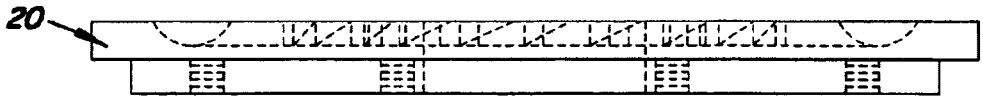
FIG. 8. is a side elevational view of the glide collar's lower bearing plate shown in FIG. 7.
Figure 9:
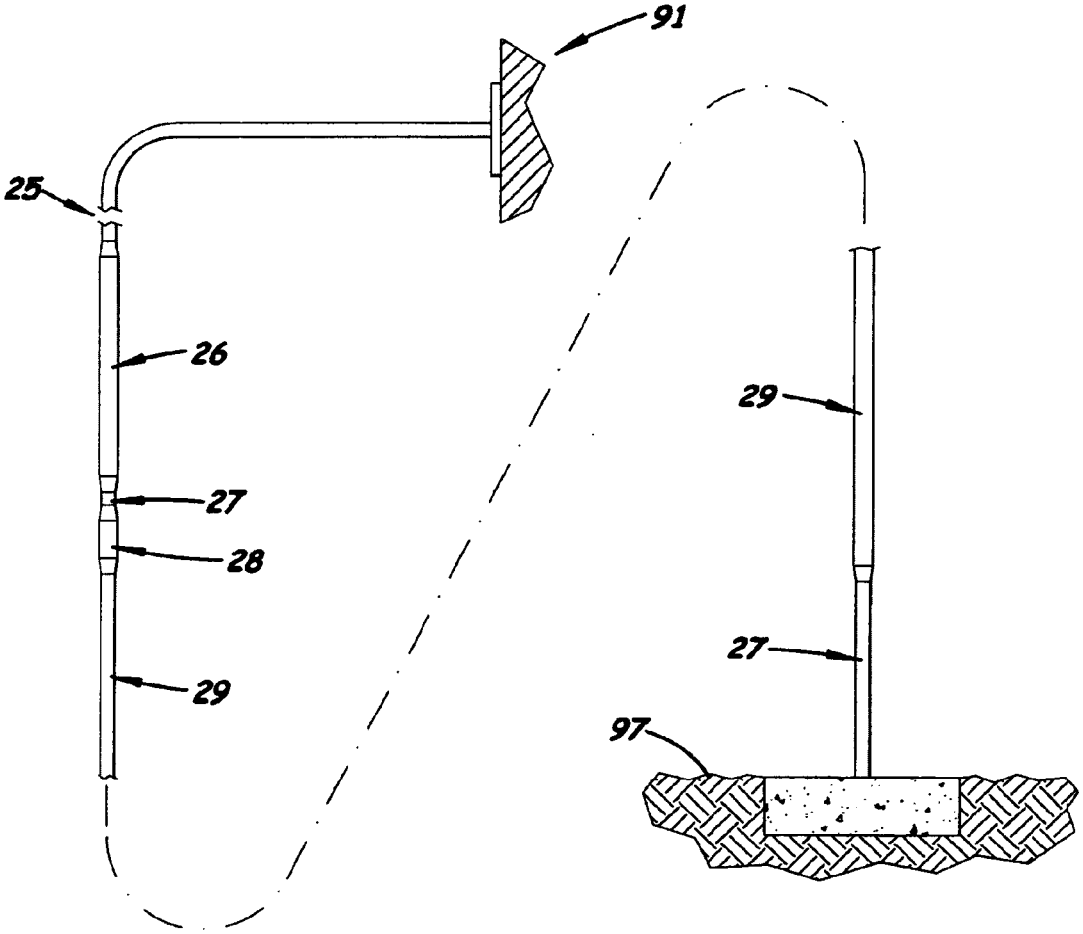
FIG. 9 is a side elevational view of a friction rod.

As shown in FIGS. 5, 7 and 8, the lower bearing plate 20 is a flat, circular structure with a central opening 47 which is aligned and registered with the circular opening 19 formed on the upper bearing plate 16. The lower bearing plate 20 is slightly smaller in diameter than the upper bearing plate 16 so that it may rotate freely inside the retaining ring 17. The glide rod 12 extends through both openings 45, 47 in the upper and lower bearing plates 16, 20, respectively.

Figure 6:
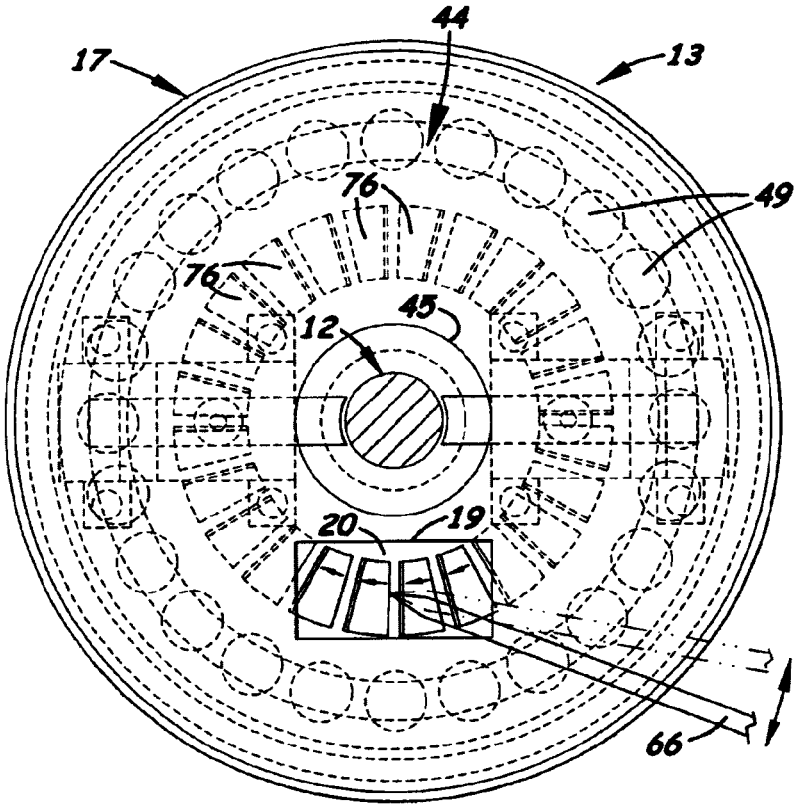
FIG. 6 is a top plan view of the glide collar.

Formed on the top surface of the lower bearing plate 20 near its perimeter edge is a lower bearing raceway 48 which is aligned and registered with the bearing raceway 44 formed on the upper bearing plate 16. Disposed inside the two raceways 44, 48 are a plurality of rollers or ball-bearings 49. Formed on the inside surface of the lower bearing plate 20 is a set of inclined teeth 76. The set of inclined teeth 76 are arranged in a circular pattern and coaxing aligned with the central opening 47. Formed on the upper bearing plate 16 is an optional opening 45 in which a lever bar 66 may be inserted. As shown in FIG. 6, the tip of the lever bar 66 may be inserted into the opening 45 and used to pry against the set of incline teeth 76, thereby forcing the lower bearing plate 20 to rotate under the upper bearing plate 16.

Referring to FIG. 5, attached to the lower surface of the lower bearing plate 20 on opposite sides of the central opening 47 are two downward extending brackets 50, 52. Attached to one bracket (bracket 50 shown) is a spacer block 54 used to position the bracket 50 at a lower position on the glide rod 12 than the opposite bracket 52. Suitable threaded bolts 55 are used to attach the two brackets 50, 52 and spacer block 54 to the lower bearing plate 20. Pivotally attached to each bracket 50, 52 is an inward extending glide point 56. In the preferred embodiment, each glide point 56 is an elongated structure with a curved upper edge 57 and a straight lower edge 58. During use, the lower edge 58 travels over the top surface of the vane 14 on the glide rod 12. The tip of the glide point 56 is pointed and designed to extend into the spiral groove 15 and between the upper and lower vanes 14 formed on the glide rod 12. Disposed between each glide point 56 and the lower surface of the lower bearing plate 20 is a spring 59 that bias the glide point 56 in an upward direction. When the support platform 60 is raised on the glide rod 12, the two glide points 56, 56' pivot downward to allow the glide collar 13 to pass over the vanes 14. As shown in FIGS. 2 and 3, attached to the sides of the support platform 60 are two laterally extending glide brackets 68, 70 that surround the two friction rods 25, 25'. Each glide rod bracket 68, 70 includes a bore 69, 71 that receives the adjacent friction rod 25, or 25' respectively. During use, the glide rod brackets 68, 70 slide over the friction rods 25, 25', respectively, and act to stabilize the support platform 60 as it moves over the glide rod 12 between the escape opening 94 and the ground 97.

Figure 16:
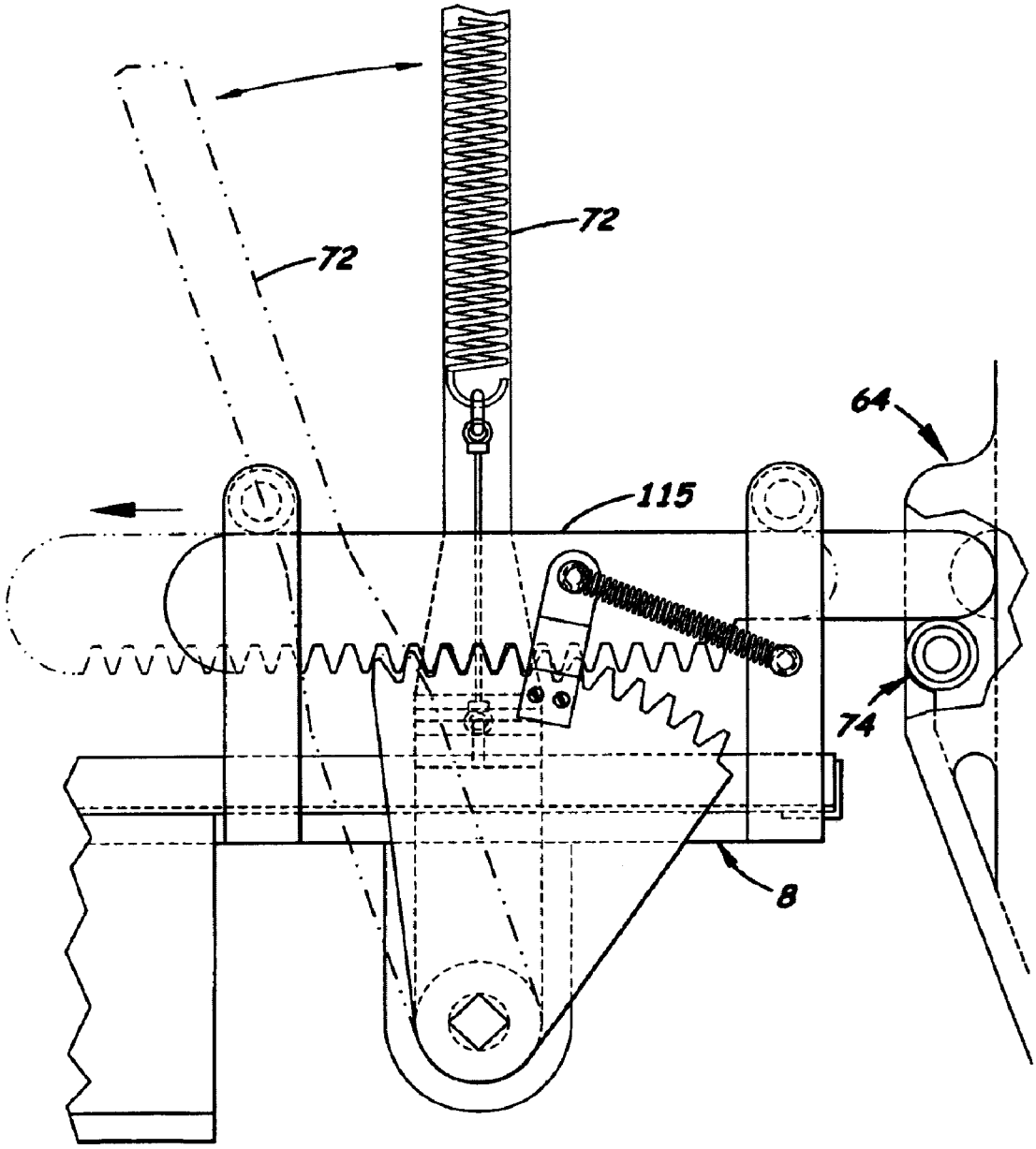
FIG. 16 is a side elevational view of a release arm on the lower frame engaging a connection plate.
Figure 17:
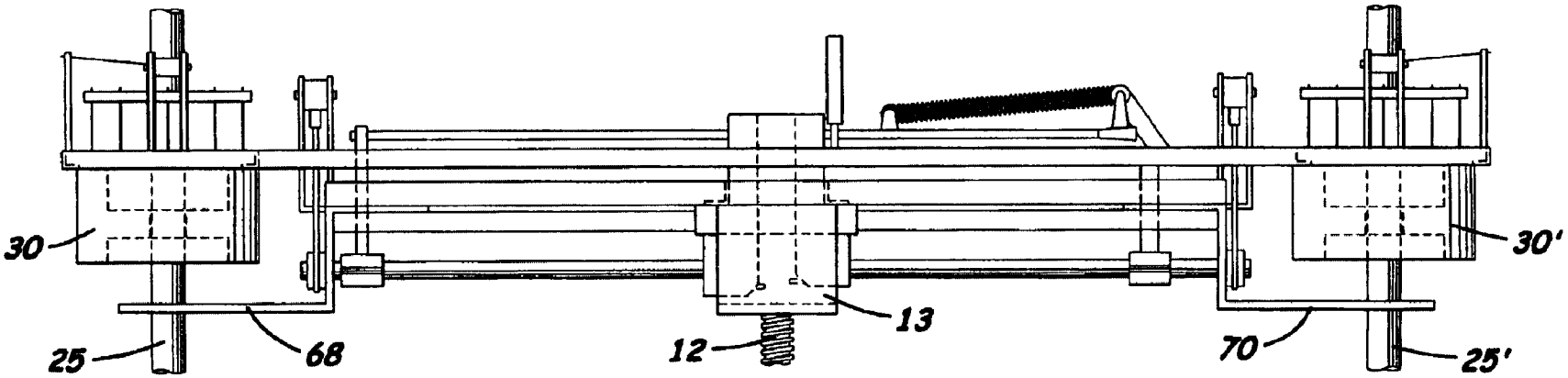
FIG. 17 is a side elevational view of the upper and lower frame assemblies in a collapsed, stored position.
Figure 18:
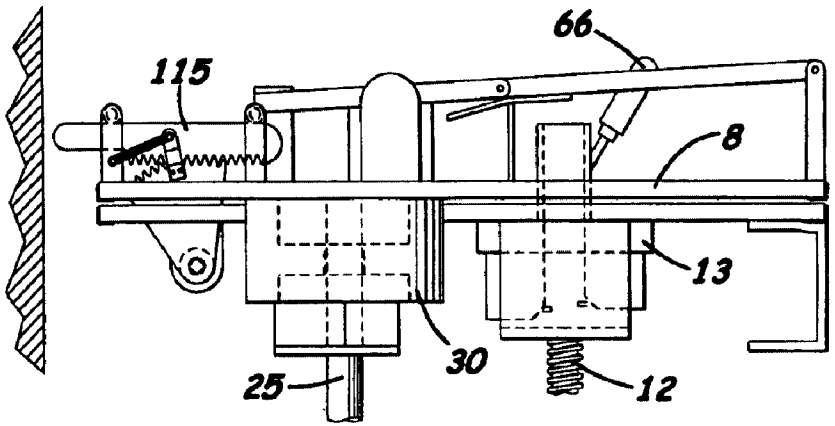
FIG. 18 is a side elevational view of the upper and lower frame assemblies in a collapsed, stored position.

The two friction rods 25, 25' and the two friction collars 30, 30' are used to expand the canopy 62 and slowly lower the upper frame assembly 10 from a stored position 93 to the escape opening 94. As shown in FIG. 16, formed on the upper ends of the friction rods 25, 25' are upper brackets that attach to the wall 91 at a location above the escape opening 94. Each friction rod 25, 25' includes different diameter sections 26, 27, 28, and 29 that gradually taper from one diameter to another along the entire length to control the rate of descent of the friction collar 30, 30', thereover. In the preferred embodiment, the section of each friction rod 25, 25' located above the escape opening 94 has a wide diameter so that friction collars 30, 30' descend slowly over the friction rod 25, 25', respectfully, in a resisted manner.

Figure 10:
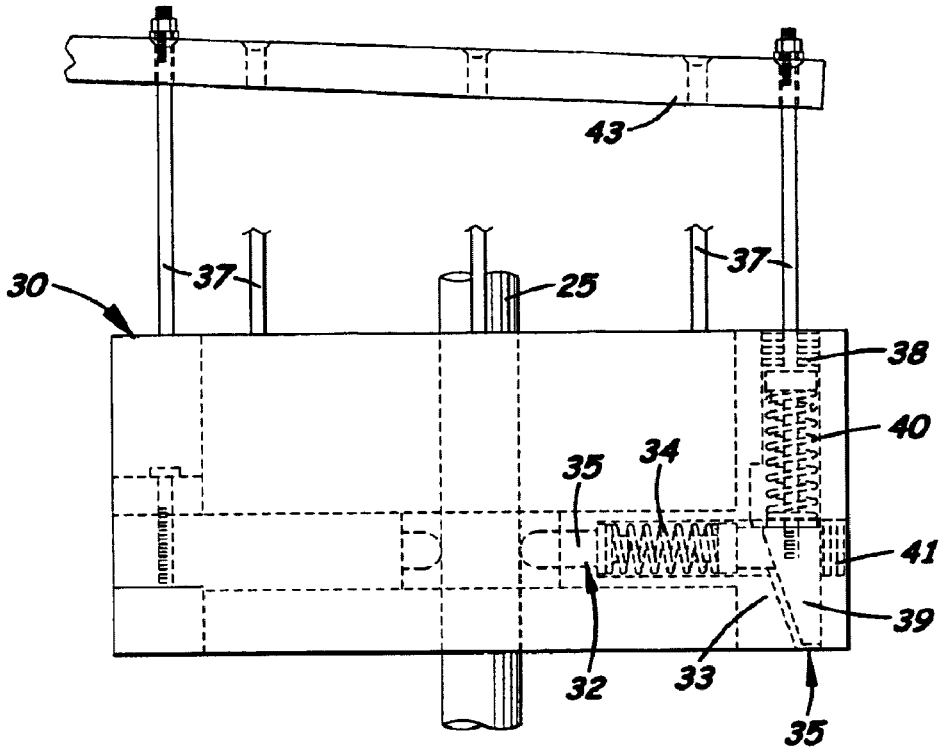
FIG. 10 is a side elevational view of a friction collar.
Figure 11:
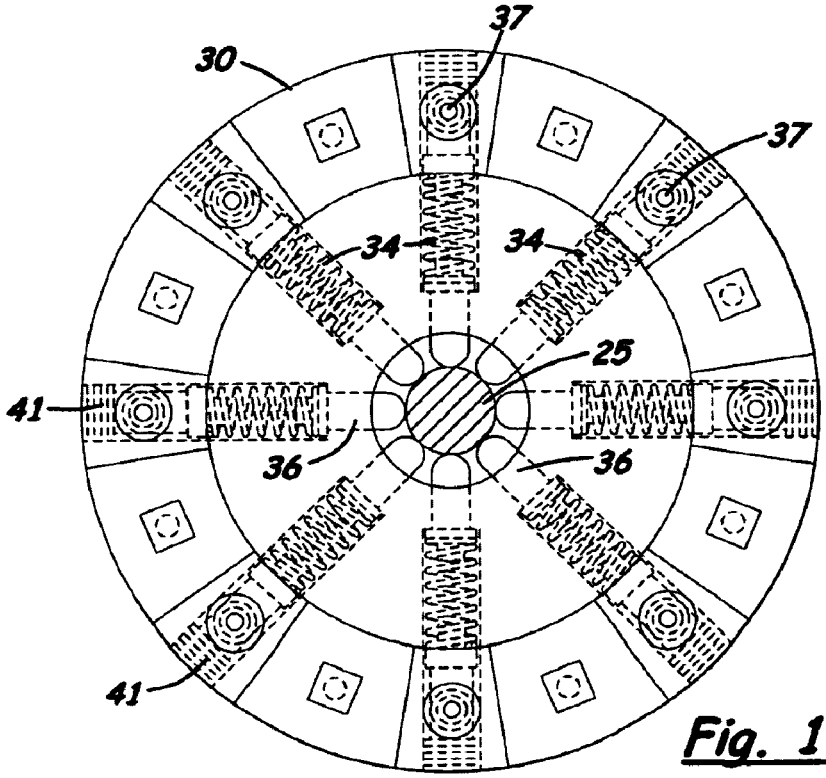
FIG. 11 is a top plan view of the friction collar.
Figure 12:
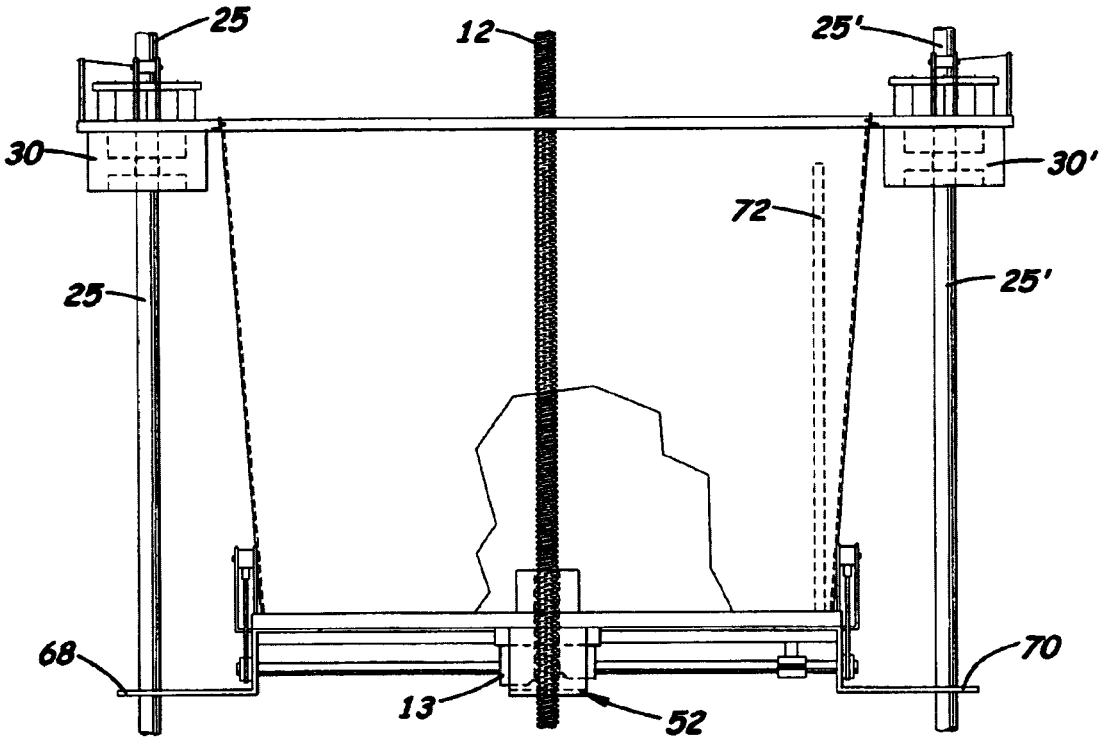
FIG. 12 is a front elevational view of the carriage showing the release lever.
Figure 13:
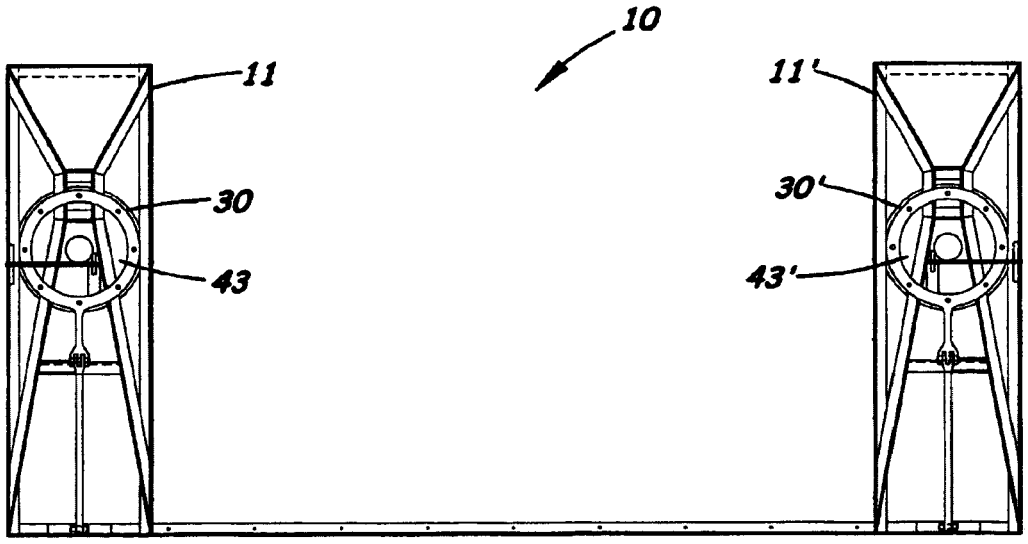
FIG. 13 is a top plan view of the upper frame assembly.
Figure 14:
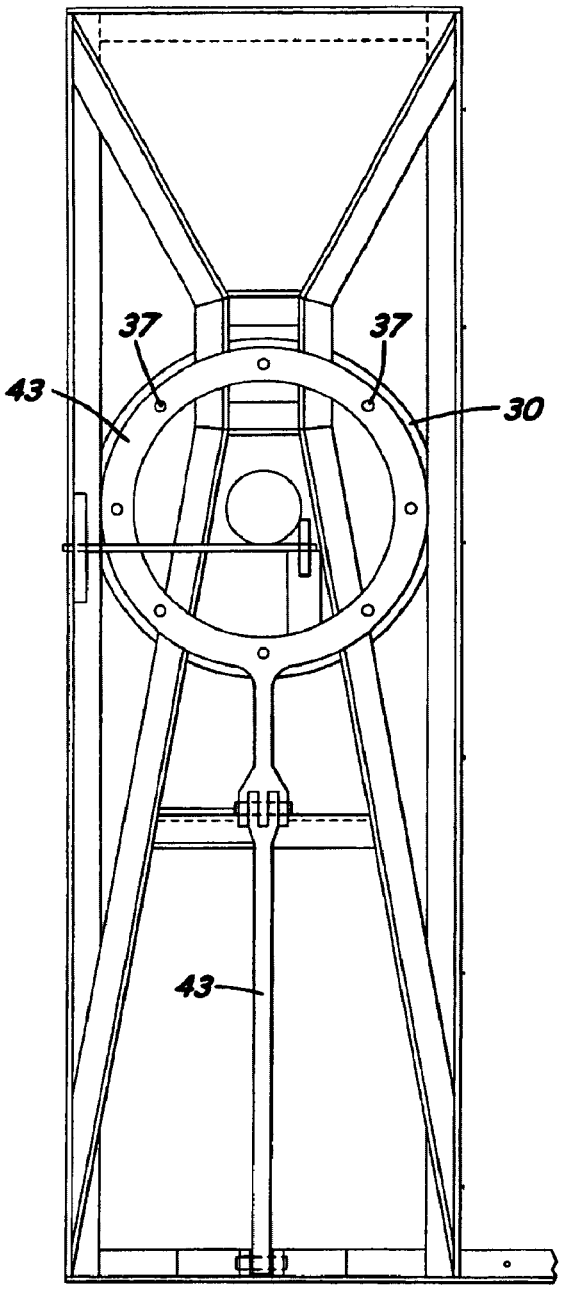
FIG. 14 is a top plan view of an upper side frame used to hold the friction collar.
Figure 15:
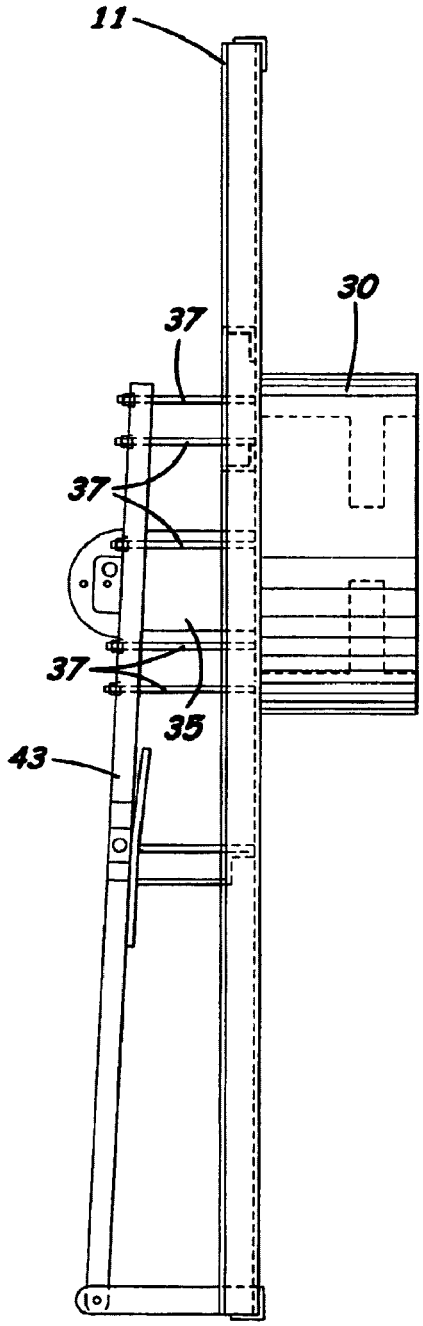
FIG. 15 is a side elevational view of the upper side frame.

The two friction collars 30, 30' are mounted on upper side frames 11, 11' located on the opposite sides of the upper frame assembly 10. As shown in FIGS. 10 and 11, each friction collar (friction collar 30 shown) includes a center bore 31 designed to receive the adjacent friction rod 25. Aligned transversely on each friction collar 30 are at least two adjustable spring loaded friction points 32. Each friction point 32 fits inside a transversely aligned passageway 33 formed on the collar 30. Each plunger 32 includes an internal spring 34 that forces the friction points inward in the passageway 33 and against the surface of the friction rod 25. In the preferred embodiment, each friction collar 30, 30' includes eight or more, radially aligned spring-loaded friction points 32.

Formed near the perimeter edge of each friction collar 30, 30' is a wedge-shaped passageway 35 with a converting section designed to receive a wedge-shaped control pin 37.

The control pin 37 slides through a threaded nut 38 located at one end and a wedge body 39 located at its opposite end. A spring 40 is disposed around the control pin 37 and used to force the wedge body 39 into the converting section of a passageway 35. Located inside the passageway 33 is a plunger nut 41. Located against the inside surface of the wedge body 39 and inside the passageway 33 is a plunger 42. The spring 34 presses against the plunger 42 at the inside surface of the friction points 36. By adjusting the length of the control pin 37 inserted into the passageway 35, the amount of force applied by the friction point 36 against the side of the friction rod 25 may be adjusted. A control lever 43 is used to control the length of the control pins 37 used with each friction point 32.

During operation, the frictional resistance of the friction collar 30 as it passes over the different diameter sections 26, 27, 28, 28' and 29 is a function of the internal spring 34 located inside each friction point 32. As the friction collars 30, 30' pass over the friction rods 25, 25', respectfully, the frictional resistance of the friction collars 30, 30' over the friction rods 25, 25' depends on the biasing pressure exerted by the springs 34 on the friction points 36. During assembly, the amount of pressure exerted by the spring 34 on the plunger 32 is adjusted so that the friction collars 30, 30' slide slowly over the intermediate and wide diameter sections 26, 27, 28, 29 and freely over the narrow diameter sections 28, 28'. During assembly, the amount of pressure exerted by the friction points 36 may be selected for less or greater escape carriage and load weights. When the gravitational forces exerted on the support platform 60 exceed the frictional forces exerted by the friction collars 30, 30', on the two friction rods 25, 25', and by the glide collar 13 on glide rod 12, respectfully, the support platform 60 descends. When the frictional resistance of the friction collars 30, 30', and the glide collar 13 exceeds the gravitational forces on the support platform 60, the rate of descend of support platform 60 decreases and gradually stops.

As stated above, the lower frame assembly 8 and upper frame assembly 10 are lifted and stored in a collapsed configuration in a stored position 93 located above the escape opening 94. Formed on the sides of the building on opposite sides of the escape opening 94 are two docking brackets 64, 64' that are engaged by the stop, release arms 115, 115' when the lower frame assembly 8 is positioned adjacent to the escape opening 94. As shown in FIG. 16, each stop release arm 115, 115' engages the brackets 64, 64' respectfully. The stop release bar 115 on the lower frame assembly 8 that extends rearward from the lower frame assembly 8. Attached to the lower frame assembly 8 is a support platform release lever 72 coupled to the two release arms 115, 115'. During use, the support platform release lever 72 is pulled rearward which disengages the release bars 115, 115' from the brackets 64, 64', respectfully, thereby allowing the lower frame assembly 8 to descend to the ground 97.

As the escape carriage 7 descends to the ground, the diameter of the friction rods 25, 25' is sufficient so that the friction collars 30, 30' continue to slightly engage the friction rods 25, 25', so that the canvas sidewalls of the carriage 7 remain extended as the carriage 7 descends. When the lower frame assembly 8 is approximately 1 foot above the ground 97, the diameter of the friction rods 25, 25' is reduced thereby allowing the upper frame member 10 to fall, so that the flexible carriage walls 62 are allowed to drop to allow the user to easily depart from the carrieage 7. The lower ends of the friction rods 25, 25' and glide rod 12 are embedded in concrete footings constructed on the ground 97 while the upper ends of the friction rods 25, 25' and glide rod 12 are attached to cross-bracing located above the escape opening 94 that extend outward from the walls 91 of the building 90.

In the preferred embodiment, a hatch release on the escape opening 94 is coupled to the stop release bar 115. When the hatch release is pulled the carriage 7 is released from the storage position 93. Because movement of each friction collar 30, 30' is unimpeded over the friction rods 25,25' and because support platform 60 falls freely, the flexible carriage walls 62 automatically expand to form a 3-sided enclosure for the user. After loading onto the support platform 60, the support platform release handle 72 is pulled to allow the support platform 60 to slowly descend to the ground.

As stated above, the friction collar 30, 30' and friction rod 25, 25' are well suited for deployment of the support platform 60 from an elevated, collapsed stored position located above an escape opening 94. However, since the friction collars 30, 30' are is not sensitive to load weight variation or loading eccentricity, they are not well suited to control the descend of the loaded support platform 60 from the escape opening 94 to the ground 97. Since the glide collar 13 and glide rod 12 are sensitive to live load weight variations, they are well suited to control descend of the loaded support platform 60 from the escape opening 94 loading position to the ground 97.

Also shown in FIGS. 1A–K, is an optional re-lift cable 80 attached to the carriage 7 for raising the support platform 60 from the ground 97 to the escape opening 94 or to the stored position 93. In the preferred embodiment, the re-lift cable 80 is mounted on a pulley 82 attached to the building above the carriage storage position 93. The re-lift cable 80 is sufficient in length to allow a second user located within the building at the escape door 94 to hoist the carriage 7 back to the escape door 94.

In the preferred embodiment, the glide rod 12 is approximately 1 to 2 inches in diameter and made of hard steel or aluminum. The friction rods 25, 25' vary in diameter between 1 to 2 inches and are also made of hard steel. The glide collar 13 and friction collars 30, 30' are also made of steel and/or light alloy and are 6 to 10 inches in diameter. The support platform 60 is designed to connect to the top surface of the upper glide collar bearing plate 16. In the preferred embodiment, the support platform 60 measures approximately 36 inches by 48 inches. The pitch of the vanes 14 on the glide rod 12 is sufficient so that the support platform 60 descends at a desired rate for each revolution of the lower glide collar bearing plate 20.

OPERATION

As stated above, the support platform 60 is located in a stored, position 93 located above the escape opening 94. When the escape system 6 is activated, the stored escape carriage 7 is released. The lower frame assembly 8 is momentarily allowed to fall freely while the upper frame assembly 10 is momentarily retrained. This allows the flexible carriage walls 62 to expand so that the escape carriage 7 is fully extended when it is arrested by the building mounted brackets 64 located on the wall adjacent to the building escape opening 94. Docking of the escape carriage 7 at the escape opening 94 allows the building escape door to be opened for escape carriage loading.

As the lower frame assembly 8 approaches the escape opening 94, the carriage stop/release bars engage the building mounted brackets 64, 64' located adjacent to the escape opening 94, and block further descent of the lower frame assembly 8 on the glide rod 12 and the top frame 10 is stopped, with the carriage walls 62 extended, by the top frame friction collars 30, 30'. The user may then move through the escape opening 94 and onto the support platform 60. The user then activates the support platform release lever 72, which disengages the release bars 115 from the building mounted brackets 64, 64' thereby allowing the carriage 7 to descend. When the carriage 7 nears the unloading area on the ground 97, the diameter of the friction rods 25, 25' gradually decrease thereby decreasing the amount of frictional forces exerted by the frictional collars 30, 30' on the friction rods 25, 25', respectively. Concurrently, the pitch of the glide rod vane 14 is decreased which causes greater glide collar 13 resistance. This results in a decrease in the descent of the load carrying bottom frame 8 while allowing the top frame 10 to collapse the escape carriage walls 62.

When the carriage 7 is approximately 1 foot above the ground, the diameter of the friction rods 25, 25' decreases thereby allowing the friction collars 30, 30' to fall and the carriage walls 62 are lowered to allow the user to easily walk off the support platform 60. When the support platform 60 is in the collapsed position, the re-lift cable 80 is used to lift the support platform 60 to the escape opening 94 or to the original stored location. When the support platform 60 reaches the escape opening 94, the release bars 115, 115' re-engage the building mounted brackets 64, 64'.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

We claim:

1. A load lowering system, comprising:

a. at least one friction rod vertically mounted on a building;

b. a friction collar disposed around said friction rod;

c. means for creating a friction force between said friction collar and said friction rod that resists movement of said friction collar over said friction rod;

d. at least one glide rod vertically mounted on a building, said glide rod being spaced apart from and parallel to said friction rod, said glide rod including a spiral groove and a spiral vane formed thereon;

e. a glide collar disposed around said glide rod, said glide collar including means for engaging said spiral vane on said glide rod thereby said glide rod to rotate as said glide collar travels over said glide rod; and, f. a support platform disposed perpendicularly to said friction rod and said glide rod, said support platform being supported by said glide collar attached to said glide rod.

2. The load lowering system, as recited in claim 1, wherein said means for creating the amount of friction force is a plurality of biased friction points on said friction collar that press against said friction rod.

3. The load lowering system, as recited in claim 2, wherein said friction collar includes means for adjusting the amount of friction force between said friction collar and said friction rod.

4. The load lowering system, as recited in claim 3, wherein said means for adjusting the amount of friction forces are adjustment springs that adjust the amount of biasing forces extended by said friction points.

5. The load lowering system, as recited in claim 1, wherein said friction rod varies in diameter along its length thereby changing the amount of frictional force applied by said friction collar to said friction rod.

6. The load lowering system, as recited in claim 2, wherein said friction rod varies in diameter along its length.

7. The load lowering system, as recited in claim 1, wherein said glide collar includes an upper bearing plate securely attached to said support platform and a rotating lower bearing plate that rotates around said glide rod when said support platform moves longitudinally over said glide rod.

8. The load lowering system, as recited in claim 7, wherein said friction collar includes means for adjusting the amount of friction force exerted by said means for creating friction force between said friction collar and said friction rod.

9. The load lowering system, as recited in claim 8, wherein said friction collar includes means for adjusting the amount of friction force exerted by said friction collar on said friction rod.

10. The load lowering system, as recited in claim 9, wherein said friction rod varies in diameter along its length to vary the amount of frictional force exerted by said friction collar on said friction rod.

11. The load lowering system, as recited in claim 7, further including a set of bearings disposed between said upper bearing plate and said lower bearing plate enabling said lower bearing plate to rotate relative to said upper bearing plate.

12. The load lowering system, as recited in claim 8, further including a retaining ring attached to the bottom surface of said upper bearing plate and used to hold said lower bearing plate under said upper bearing plate.

13. The load lowering system, as recited in claim 11, further including at least one vane glide plate attached to said lower bearing plate that slides over said spiral vane on said glide rod as said glide collar moves longitudinally over said glide rod.

14. The load lowering system, as recited in claim 12 further including at least one vane glide plate attached to said lower bearing plate that slides over said spiral vane on said glide rod as said glide collar moves longitudinally over said glide rod.

15. The load lowering system, as recited in claim 1 further including a collapsible canopy attached to said support platform.

16. The load lowering system, as recited in claim 1 further including an upper frame assembly located above said support platform said upper frame assembly being attached to said friction collars when attached to said friction rods.

17. The load lowering system, as recited in claim 16 further including a canopy disposed between said upper frame assembly and said support platform.

18. The load lowering system, as recited in claim 1 further including a hitch bracket attached to each said friction rod for holding said support platform in a stored raised position when not in use.

19. The load lowering system, as recited in claim 17, further including a release lever coupled to said support platform to disengage said support platform from said bracket to allow said support platform to descend over said friction rod and said glide rod to a loading position.

20. The load lowering system, as recited in claim 1, further including a cable attached to said support platform used to raise said support platform on said friction rod and said glide rod.

* * * * *